US007510430B2

(12) United States Patent
Zhang et al.

(10) Patent No.: US 7,510,430 B2
(45) Date of Patent: Mar. 31, 2009

(54) ELECTRICAL CONNECTORS WITH DETECT TERMINAL

(75) Inventors: Dong-Ming Zhang, Kunshan (CN); Ji-Chao Wang, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/075,144

(22) Filed: Mar. 10, 2008

(65) Prior Publication Data

US 2008/0220651 A1 Sep. 11, 2008

(30) Foreign Application Priority Data

Mar. 9, 2007 (CN) ..... 2007 2 0035286

(51) Int. Cl.
*H01R 13/60* (2006.01)

(52) U.S. Cl. ..... 439/541.5; 439/607; 439/79

(58) Field of Classification Search ..... 439/541.5, 439/79, 607, 488, 63
See application file for complete search history.

(56) References Cited

U.S. PATENT DOCUMENTS 5,035,651 A 7/1991 Dixon
5,417,585 A * 5/1995 Morin et al. ..... 439/488
6,126,481 A * 10/2000 Wu et al. ..... 439/541.5
6,149,459 A * 11/2000 Yang ..... 439/541.5
6,227,904 B1 * 5/2001 Wang et al. ..... 439/541.5
6,688,913 B2 * 2/2004 Li ..... 439/541.5

FOREIGN PATENT DOCUMENTS

CN 200959429 10/2007

* cited by examiner

*Primary Examiner*—Hien Vu
(74) *Attorney, Agent, or Firm*—Wei Te Chung

(57) ABSTRACT

An electrical connector (1) for mating with a plug (10) includes an insulative housing (2) with opposed front and rear faces and a detect terminal (4) retained in the insulative housing (2). The insulative housing (2) has an annular recess (25) extending from the front face and a cylindrical portion (26) disposed in the annular recess (25). The cylindrical portion (25) defines a plurality of passageways (261) extending therethrough and a rectangular groove (262) communicated with the annular recess (25). An internal shield (8) received in the annular recess (25) has a slot (282) aligned with the groove (262) and a cutout (83) staggered with the groove (262). A plurality of contacts (3) retained in the insulative housing (2). The detect terminal (4) has a detective portion (42) extending into the cutout (83) and a soldering portion (44) extending out of the insulative housing (2).

9 Claims, 8 Drawing Sheets

2

ELECTRICAL CONNECTORS WITH DETECT TERMINAL

BACKGROUND OF THE INVENTION

1. Field of the Invention

The present invention relates to electrical connectors, and more particularly to electrical connectors with a detect terminal.

2. Description of Related Art

Electrical connectors are employed widely in computers, audio equipment, video equipment and other electrical components to enable the connection of one such component to another. Generally, the electrical connectors comprise a plurality of terminals which are mounted in an insulative housing. Such electrical connectors may be mounted to a circuit board of an electrical component, with the terminals being electrically connected to conductive areas on the circuit board. A mating plug may then be connected with the electrical connector to transmit signals to the electrical connector.

U.S. Pat. No. 5,035,651 discloses such an electrical connector which is provided for mounting to a circuit board. The electrical connector comprises an insulative housing having a front face and a rear face opposite to the front face. The insulative housing includes an annular recess extending from the front face and a cylindrical portion disposed within the annular recess. The cylindrical portion defines a plurality of passageways extending therethrough for receiving a plurality of corresponding signal contacts. The cylindrical portion and the insulative housing each defines a rectangular groove communicated with the annular recess to mate with a protrusion of the mating plug. The protrusion can be projected outwardly or inwardly to avoid an improper insertion of the mating plug. An outer shield encloses three side walls of the insulative housing. An inner shield is received in the annular recess. A plurality of contacts retained in the insulative housing and each contact has a contact portion retained in the passageways and a soldering portion to connect with the circuit board.

In view of the above, the electrical connector just has a plurality of contacts to connect with corresponding contacts of the mating plug. Thereby when the mating plug mates with the electrical connector, a system can not identify whether the mating plug has inserted or not, and can not know whether the electrical connector works natural or not. It will bring a great inconvenience to users.

Hence, an electrical connector with a detect component is needed to solve the problem above.

BRIEF SUMMARY OF THE INVENTION

According to one aspect of the present invention, an electrical connector for mating with a plug includes an insulative housing comprising opposed front and rear faces. The insulative housing includes an annular recess extending from the front face and a cylindrical portion disposed within the annular recess. The cylindrical portion defines a plurality of passageways extending therethrough and a rectangular groove communicated with the annular recess. An internal shield received in the annular recess and comprises a slot generally aligned with the groove and a cutout staggered with the groove. A plurality of contacts retained in the insulative housing, each contact comprises a contact portion extending into the passageway. A detect terminal retained in the insulative housing and comprises a detective portion extending into the cutout and a soldering portion extending out of the insulative housing.

According to another aspect of the present invention, an electrical connector comprises an insulative housing having opposed front and rear faces. The insulative housing has an annular recess extending from the front face and a cylindrical portion disposed within the annular recess. The cylindrical portion defines a plurality of passageways extending therethrough and a rectangular groove communicated with the annular recess. A plurality of contacts retained in the insulative housing and each comprises a contact portion extending into the passageway. A detect terminal retained in the insulative housing and comprises a detective portion extending into the annular recess and staggered with the groove of the insulative housing, and a soldering portion extending out of the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
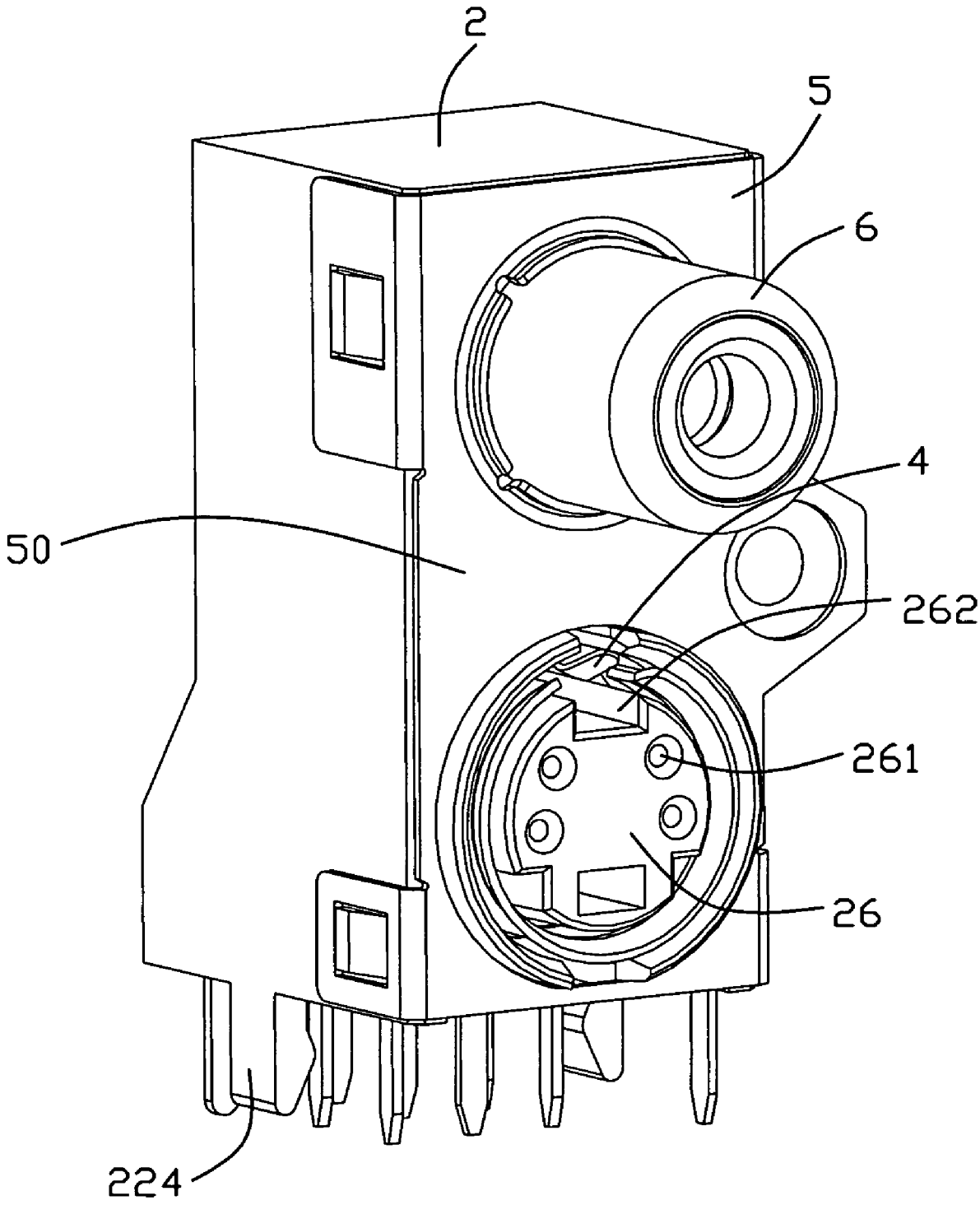
FIG. 1 is a perspective view of the preferred embodiment of an electrical connector according to the present invention.
Figure 2:
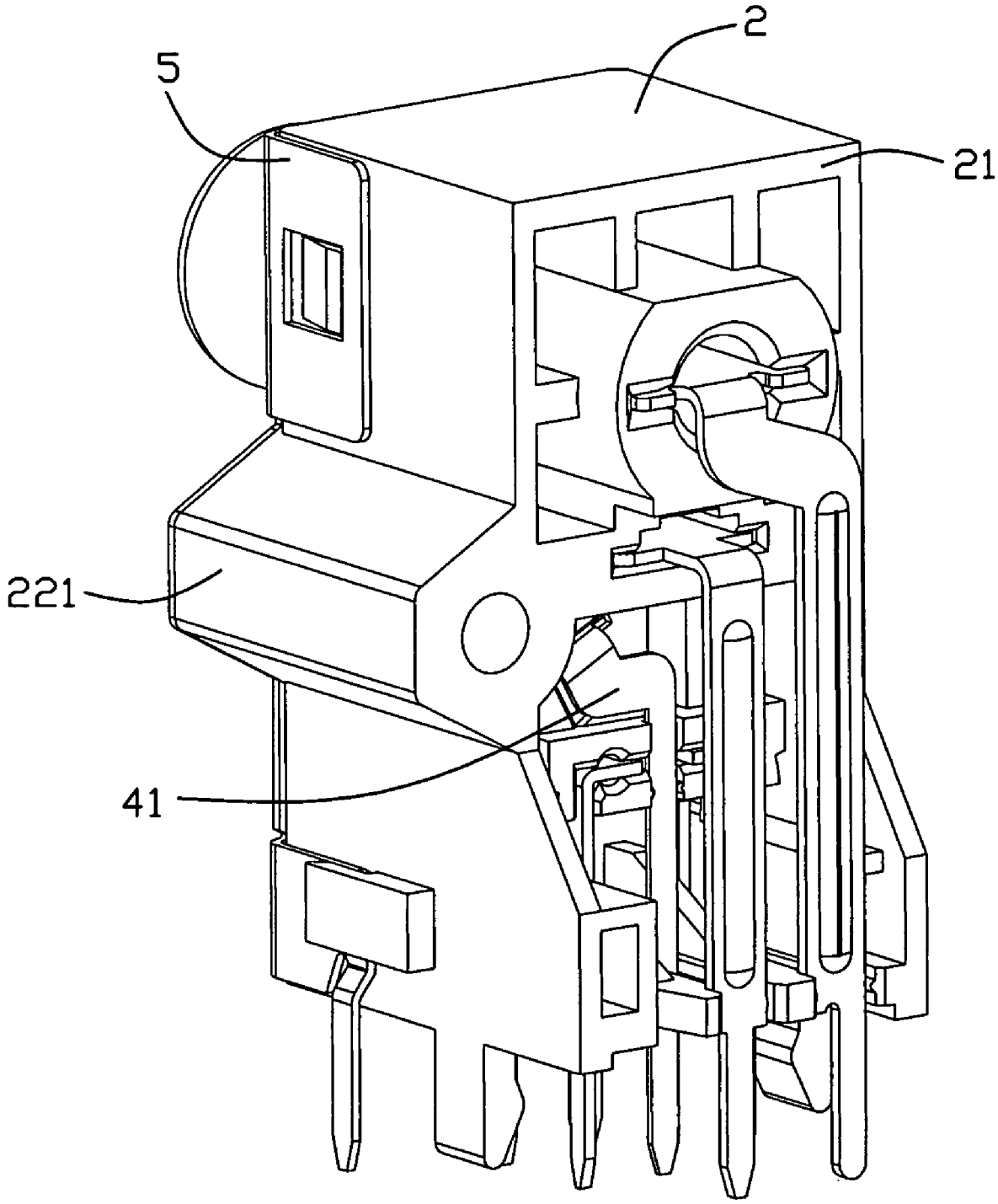
FIG. 2 is another perspective view of the electrical connector shown in FIG. 1, while taken from a different aspect.
Figure 3:
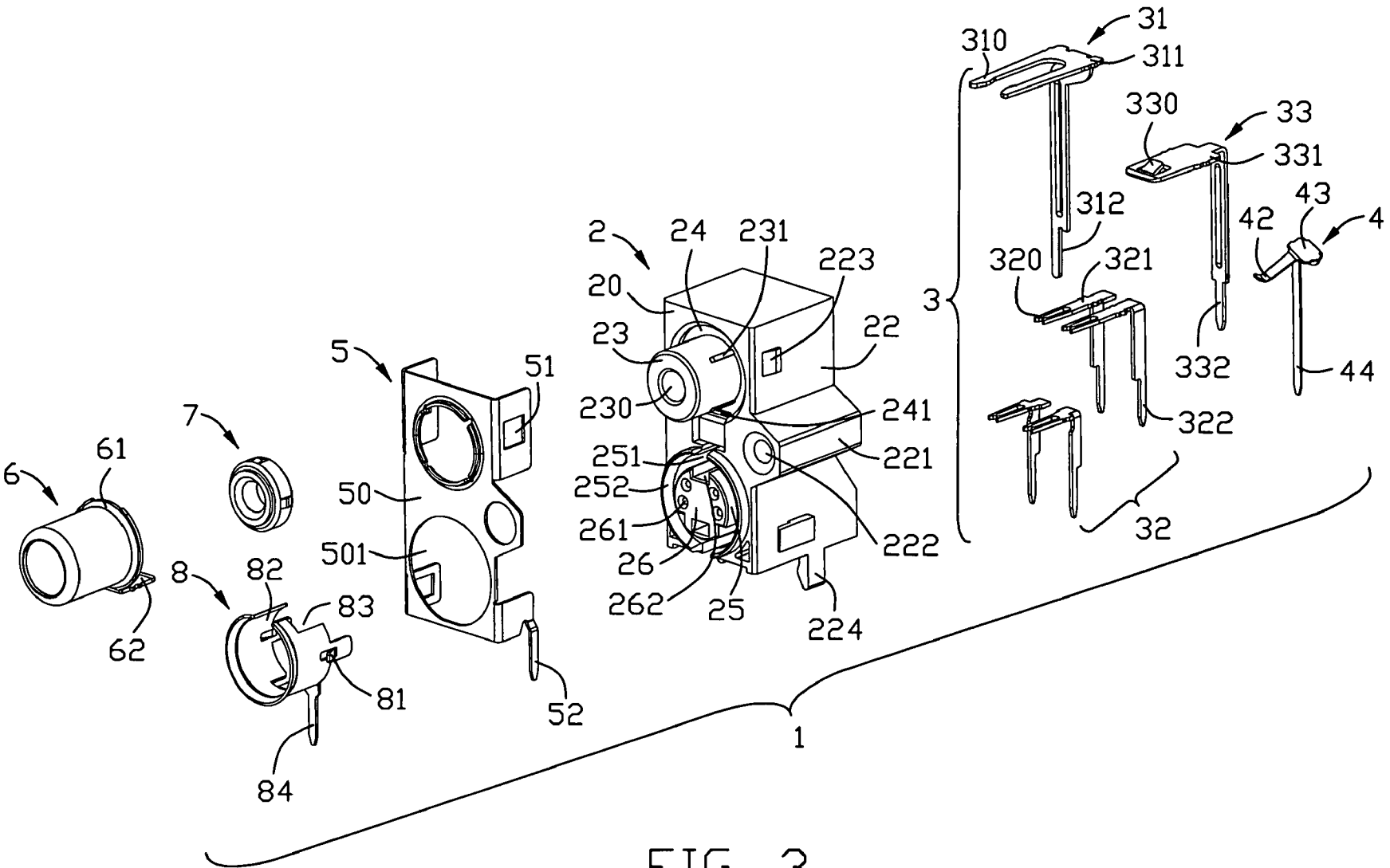
FIG. 3 is an exploded perspective view of the electrical connector shown in FIG. 1.
Figure 4:
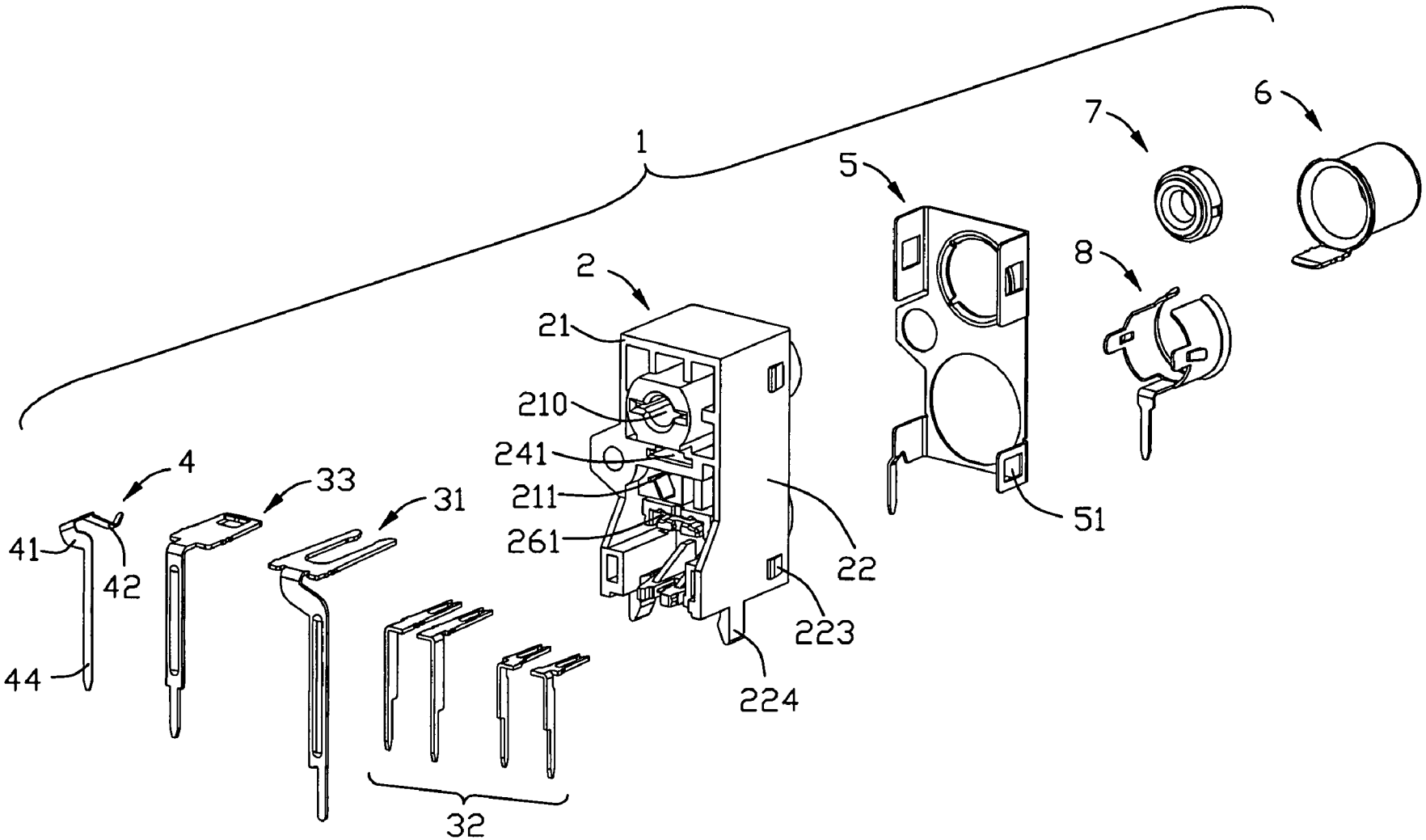
FIG. 4 is a view similar to FIG. 3, while taken from another aspect.
Figure 5:
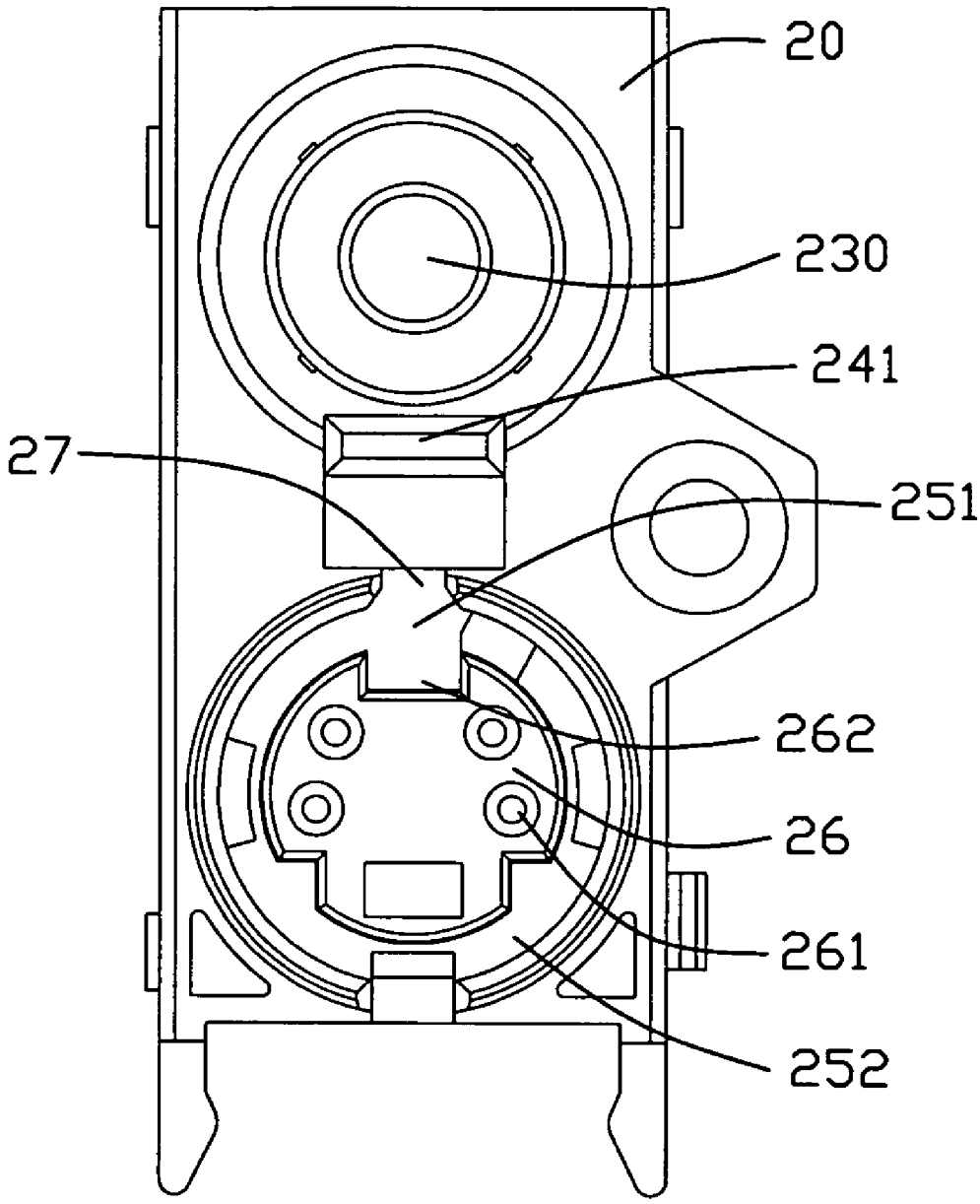
FIG. 5 is a front elevational view of an insulative housing of the electrical connector.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-8, an electrical connector 1 for mating with a corresponding plug 10 is disclosed in accordance with the present invention. The electrical connector 1 comprises an insulative housing 2, a plurality of contacts 3 and a detect terminal 4 retained in the insulative housing 2, an external shield 5 mounted on the insulative housing 2, a sleeve 6 mounted on an upper position of the insulative housing 2, a ring 7 fixed between the insulative housing 2 and the sleeve 6, and an internal shield 8 assembled in the insulative housing 2.

Referring to FIGS. 1-5, the insulative housing 2 is made of an insulative material, and has a pair of opposed front face 20 and rear face 21, and two side faces 22 connecting the mating face 20 and the rear face 21. A locking portion 221 projects from the side face 22. The locking portion 221 defines a through hole 222 for fixing the electrical connector 1 to a panel (not shown). A plurality of protrusions 223 are projecting from two side faces 22 to engage with the external shield 5. A pair of mating legs 224 extend downwardly from a lower end of the insulative housing 2.

The insulative housing 2 includes an upper interface and a lower interface arranged along an up to down direction. The upper interface comprises a columnar projection 23 projecting from the front face 20. The columnar projection 23 defines a receiving space 230 to receive a corresponding plug (not shown). The insulative housing 2 defines a passageway 210 communicated with the receiving space 230. The columnar projection 23 has a plurality of embosses 231 to engage with the sleeve 6 at a rear end. The insulative housing 2 has an annular depression 24 around the columnar projection 23 and an aperture 241 running through the insulative housing 2 below the columnar projection 23. The ring 7 affixes to a front end of the columnar projection 23. The sleeve 6 encloses the columnar projection 23 and has an opening (not labeled) corresponding to the receiving space 20. The sleeve 6 has a flange 61 assembled in the depression 24 at a rear end and a retaining portion 62 extending backwardly to engage with the aperture 241.

The lower interface defines an annular recess 25 extending from the front face 20 to receive another corresponding plug 10 and the external shield 8. A cylindrical portion 26 is disposed in the annular recess 25 and defines a plurality of passageways 261 extending therethrough and a rectangular groove 262 communicated with the annular recess 25. The annular recess 25 includes a first part 251 aligned with the groove 262 and a second part 252 besides the first part 251. The second part 252 is staggered with the groove 262. The insulative housing 2 defines a hollow 27 communicated with the annular recess 25 and aligned with the first part 251. The hollow 27 is higher than the annular recess 25. The insulative housing 2 defines a retaining cavity 211 communicated with the annular recess 25 to fasten the detect terminal 4.

The contacts 3 comprise a first contact 31 and a grounding contact 33 retained in the upper interface, and a plurality of second contacts 32 retained in the lower interface. The first contact 31 has a contact portion 310 extending into the passageway 210 to connect with the corresponding plug (not shown), a securing portion 311 retained in the insulative housing 2 and a soldering portion 312 to connect with a circuit board (not shown). The grounding contact 33 has a contact portion 330 extending into the aperture 241 to connect with the retaining portion 62 of the sleeve 6, a securing portion 331 retained in the insulative housing 2 and a soldering portion 332 connected with the circuit board. Each second contact 32 has a contact portion 320 extending into the passageways 261 to connect with the plug 10, a securing portion 321 retained in the passageways 261 and a soldering portion 322 extending out of the insulative housing 2 to connect with the circuit board (not shown).

The detect terminal 4 has a horizontal portion 41 affixed to the rear face 21 and extending along a transverse direction of the insulative housing 2, a securing portion 43 extending from one end of the horizontal portion 41, a detective portion 42 extending into the second part 252 of the annular recess 25 from the securing portion 43 and a soldering portion 44 extending out of the insulative housing 2 from the other end of the horizontal portion 41. The detective portion 42 is staggered with the groove 262 of the cylindrical portion 26.

Figure 8:
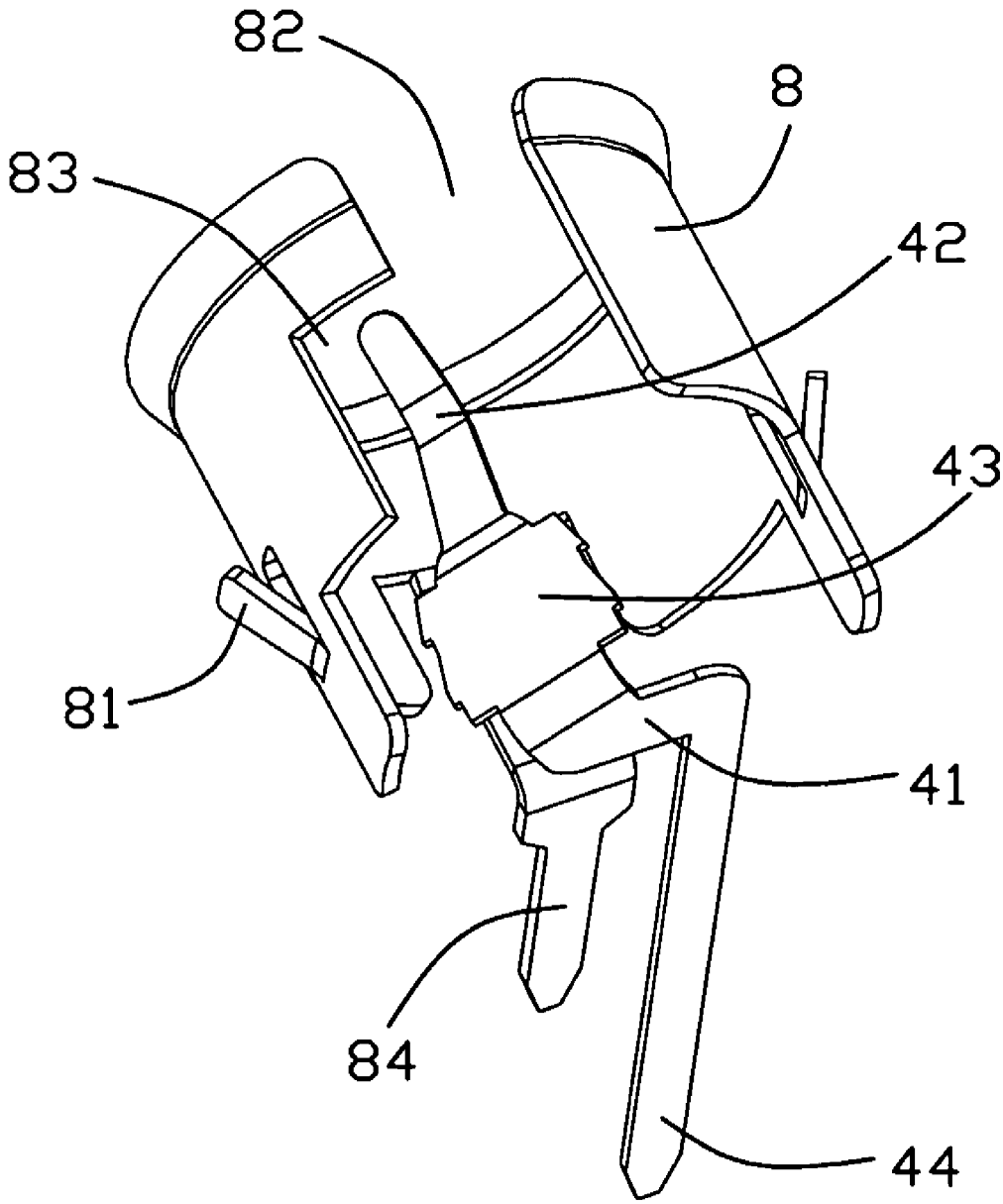
FIG. 8 is a perspective view of the detect terminal and the internal shield.

The external shield 5 has a mating face 50 covering the front face 20 and a plurality of openings 501 corresponding to the upper and lower interfaces and the through hole 222. The external shield 5 defines a plurality of mounting holes 51 engaging with the protrusions 223 of the insulative housing 2. The external shield 5 further includes a grounding leg 52 to connect with the circuit board. The internal shield 8 is received in the annular recess 25 and surrounds the cylindrical portion 26. The internal shield 8 presents as an annular shape. A plurality of locking tangs 81 are formed on the internal shield 8 to interfere with the insulative housing 2. The internal shield 8 defines a slot 82 generally aligned with the groove 262 and a cutout 83 staggered with the groove 262. The slot 82 extends through the internal shield 8. The cutout 83 is adjacent to the slot 82 and communicates with the slot 82. The detective portion 42 of the detect terminal 4 is received in the cutout 83 as shown in FIG. 8. The internal shield 8 has a grounding leg 84 extending downwardly from a rear end thereof to connect with the circuit board. The internal shield 8 and the detect terminal 4 are electrically and mechanically separated from each other.

Figure 6:
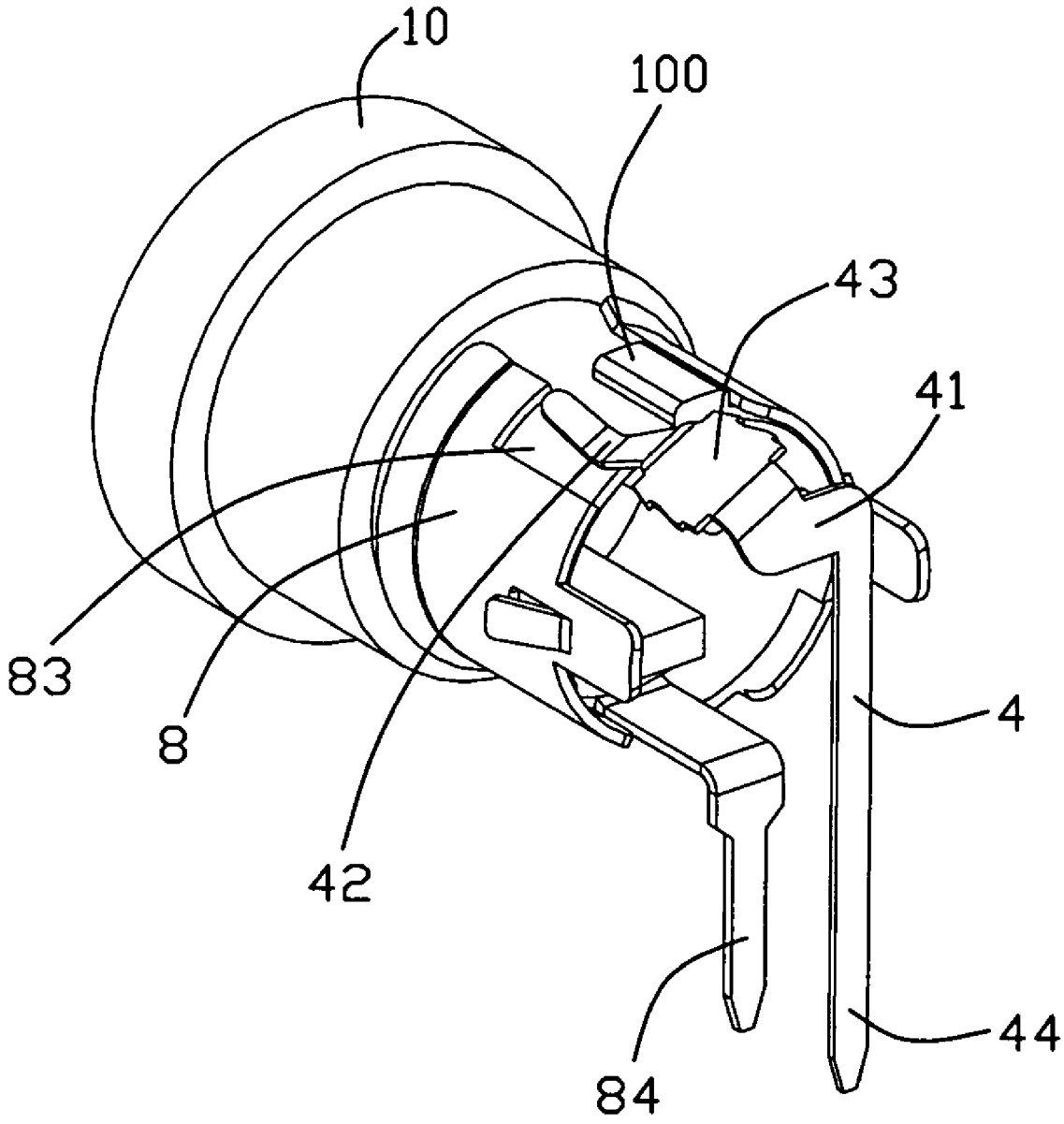
FIG. 6 is a perspective view of a detect terminal and an internal shield with the insertion of a corresponding plug, which showing the detect terminal dose not contact a protrusion of the plug.
Figure 7:
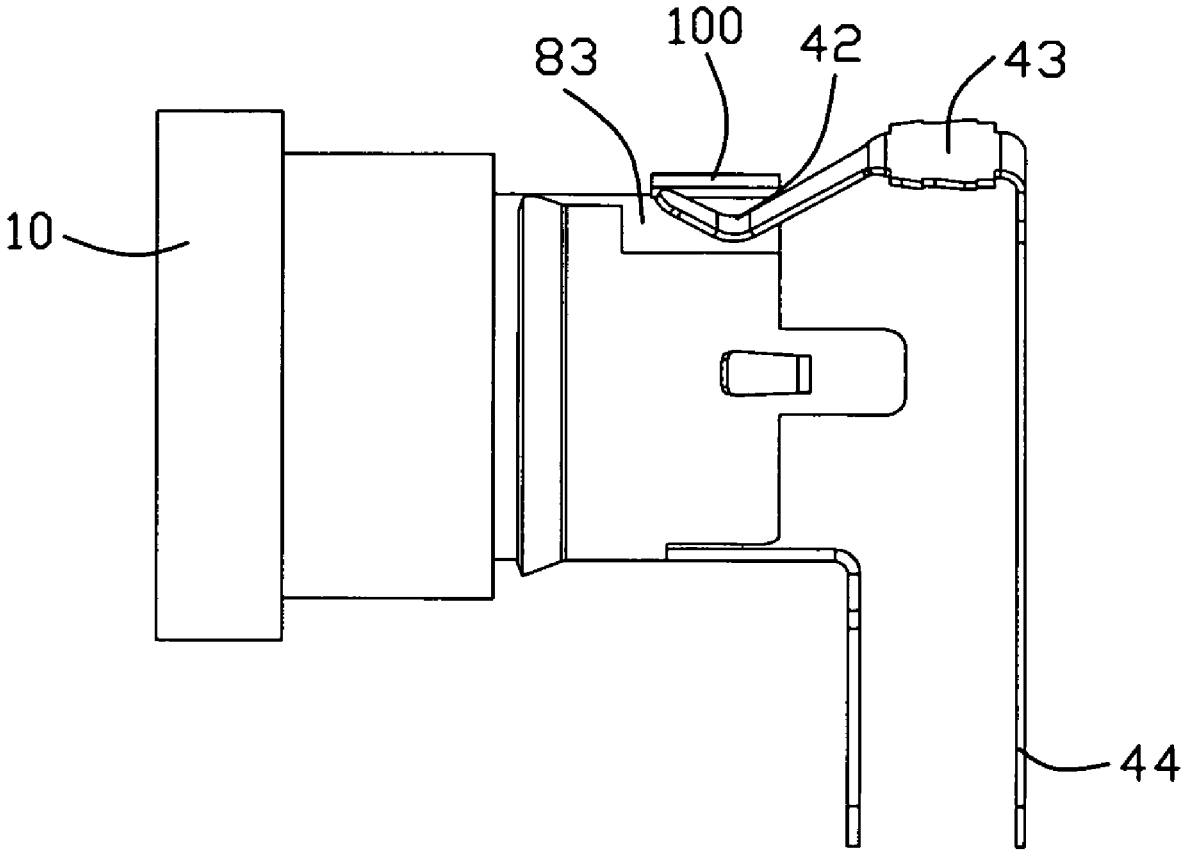
FIG. 7 is a side elevational view of FIG. 6.

Referring to FIGS. 6 and 7, the plug 10 of the present invention comprises a protrusion 100 extending outwardly. The plug 10 abuts against an inner surface of the internal shield 8 when the plug 10 mates with the lower interface. The protrusion 100 of the plug 10 is disposed into the hollow 27 of the insulative housing 2 and the slot 82 of the internal shield 8. The detective portion 42 contacts with an out surface of the plug 10 to transmit a kind of signal to the circuit board. Of course, a protrusion of another kind of the plug can be extended inwardly in other embodiment of the present invention. Then the protrusion is received in the groove 262 of the cylindrical portion 26.

According to the present invention, the electrical connector 1 disposes a detect terminal 4 additionally. Therefore, when the plug 10 inserts into the electrical connector 1, the detect terminal 4 contacts the plug 10 and transmit the signal to the circuit board for making sure the plug 10 connected with the electrical connector 1 steadily. In the present invention, the detective portion 42 of the detect terminal 4 is disposed in the second part 252 of the annular recess 25 and staggered with the protrusion of said two kinds of the plug. The detective portion 42 contacts the other part except the protrusion of the plug. So the detect terminal 4 can not contact the protrusion of the plug when the detect terminal 4 connects with the plug 10 with the protrusion 100 projecting outwardly. The detective portion 42 of the detect terminal 4 can not be resisted fiercely by the protrusion 100 and make the elasticity break-down after a longtime mating cycles with the plug 10. When the detect terminal 4 connects with the plug with the protrusion projecting inwardly, the detective portion 42 of the detect terminal 4 can contact the plug steadily too. The detective portion 42 of the detect terminal 4 can just move in a range of the second part 252, the elasticity of the detect terminal 4 performs perfectly and can not break down.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing comprising opposed front and rear faces, the insulative housing including an annular recess extending from the front face and a cylindrical portion disposed in the annular recess, the cylindrical portion defining a plurality of passageways extending therethrough and a rectangular groove communicated with the annular recess;

an internal shield received in the annular recess, the internal conductive shield comprising a slot aligned with the groove and a cutout staggered with the groove;

a plurality of contacts retained in the insulative housing, each contact comprising a contact portion extending into the passageway; and a detect terminal retained in the insulative housing and being adjacent to a ground contact, the detect terminal comprising a detective portion extending into the cutout and a soldering portion extending out of the insulative housing;

wherein the detect terminal comprises a horizontal portion extending along a transverse direction of the insulative housing, the detective portion and the soldering portion being extended from opposite ends of the horizontal portion respectively;

wherein the internal shield and the detect terminal are electrically and mechanically separated from each other; and wherein the slot extends through the internal shield and the cutout is adjacent to a front edge portion of the internal shield and communicated with the slot.

2. The electrical connector according to claim 1, wherein the internal shield surrounds the cylindrical portion and presents as an annular shape.

3. The electrical connector according to claim 1, wherein the internal shield comprises a grounding leg extending downwardly to connect with a circuit board.

4. The electrical connector according to claim 1, wherein the insulative housing comprises a columnar projection projecting from the front face, the columnar projection defining a receiving space extending therethrough.

5. The electrical connector according to claim 4, further comprising an external shield covering the front face of the insulative housing, and wherein the external shield has a grounding leg.

6. An electrical connector, comprising:

an insulative housing comprising opposed front and rear faces, the insulative housing having an annular recess extending from the front face and a cylindrical portion disposed within the annular recess, the cylindrical portion defining a plurality of passageways extending therethrough and a rectangular groove communicated with the annular recess;

a plurality of contacts retained in the insulative housing, each contact comprising a contact portion extending into the passageway; and a detect terminal retained in the insulative housing and being adjacent to a ground contact, the detect terminal comprising a detective portion extending into the annular recess and staggered with the groove of the insulative housing, and a soldering portion extending out of the insulative housing;

wherein the detect terminal further comprises a horizontal portion extending along a transverse direction of the insulative housing, the detective portion and the soldering portion being extended from opposite ends of the horizontal portion respectively;

wherein the electrical connector further comprising an internal conductive shield receiving in the annular recess, the internal shield has a grounding leg extending out of the insulative housing, a slot aligned with the groove and a cutout staggered with the groove;

wherein the internal shield and the detect terminal are electrically and mechanically separated from each other.

7. The electrical connector according to claim 6, further comprising an external shield covering the front face of the insulative housing, and wherein the external shield comprises a grounding leg.

8. An electrical connector assembly comprising:

an insulative housing defining an annular groove along a front-to-back direction and dividing said housing into inner and outer portions, a keyway formed in the inner portion to receiving a key formed in a tubular mating portion of an inserted plug which is inserted into the annular groove and a cylindrical portion disposed in the annular groove, the cylindrical portion defining a plurality of passageways extending therethrough and a rectangular groove communicated with the annular groove;

a internal metallic shell assembled to the housing and defining a tubular section received in the annular groove to essentially circumferentially and inwardly mechanically and electrically engage the tubular mating portion and a mounting section extending from the tubular section for mounting to a printed circuit board, a cutout formed in said tubular section; and;

a detective terminal positioned in the housing and being adjacent to a contact and including a deflectable contact section received in said cutout and extending into the annular groove to inwardly mechanically and electrically engage the tubular mating portion of the plug, and a mounting portion extending from the contact section for mounting to the printed circuit board;

wherein said tubular section defines an axial gap which is essentially diametrically aligned with the keyway;

wherein said gap and said cutout are communicatively adjacent to each other and said cutout staggered with said rectangular groove;

wherein said mounting section is located in front of said mounting portion along an axial direction of said annular groove.

9. The electrical connector assembly as claimed in claim 8, wherein said housing forms a passage formed in the outer portion and diametrically opposite to said keyway, and said mounting section extends through said passage downwardly.

* * * * *